US011356768B2

(12) United States Patent
Feng et al.

(10) Patent No.: US 11,356,768 B2
(45) Date of Patent: Jun. 7, 2022

(54) ACOUSTIC ABSORPTION MATERIAL AND SPEAKER

(71) Applicant: AAC Technologies Pte. Ltd., Singapore (SG)

(72) Inventors: Hongshu Feng, Shenzhen (CN); Yanyan Jin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 801 days.

(21) Appl. No.: 16/234,562

(22) Filed: Dec. 28, 2018

(65) Prior Publication Data

US 2019/0238972 A1 Aug. 1, 2019

(30) Foreign Application Priority Data

Jan. 30, 2018 (CN) ..... 201810091542.2

(51) Int. Cl.
*H04R 1/28* (2006.01)
*G10K 11/162* (2006.01)
*G10K 11/00* (2006.01)

(52) U.S. Cl.
CPC ..... *H04R 1/288* (2013.01); *G10K 11/002* (2013.01); *G10K 11/162* (2013.01)

(58) Field of Classification Search
CPC ..... H04R 1/288; G10K 11/002; G10K 11/162
See application file for complete search history.

(56) References Cited

U.S. PATENT DOCUMENTS

2013/0170687 A1* 7/2013 Papakyriacou ..... B01J 20/2808 381/338
2019/0202703 A1* 7/2019 Gao ..... B01J 20/183

FOREIGN PATENT DOCUMENTS

CN 108298559 * 7/2018

* cited by examiner

*Primary Examiner* — C Melissa Koslow
(74) *Attorney, Agent, or Firm* — IPro, PLLC; Na Xu

(57) ABSTRACT

The present disclosure provides an acoustic absorption material having a composite zeolite molecular sieve and a speaker using the acoustic absorption material, where the composite zeolite molecular sieve includes a first zeolite molecular sieve having a first micropore diameter and a second zeolite molecular sieve having a second micropore diameter, and the first micropore diameter is greater than the second micropore diameter, and the first zeolite molecular sieve is used as an adsorbent, and the second zeolite molecular sieve is used as a low-frequency enhancement material. In the present disclosure, a zeolite molecular sieve having a larger diameter is added as an adsorbent to a zeolite molecular sieve, to effectively absorb various volatile organic compounds (VOCs) in an application environment, thereby avoiding performance degradation or failure of the zeolite molecular sieve used as a low-frequency enhancement material.

19 Claims, No Drawings

ACOUSTIC ABSORPTION MATERIAL AND SPEAKER

CROSS-REFERENCE TO RELATED APPLICATIONS

This application claims the priority benefit of Chinese Patent Application Ser. No. 201810091542.2 filed on Jan. 30, 2017, the entire content of which is incorporated herein by reference.

TECHNICAL FIELD

The present disclosure relates to an acoustic absorption material and use thereof, and particularly to an acoustic absorption material and a speaker that are based on composite zeolite molecular sieve and using the composite zeolite molecular sieve.

BACKGROUND

As consumer electronics become more compact, rear cavities of speakers is getting smaller and smaller. In the prior art, low-frequency enhancement materials such as activated carbon and zeolite are introduced into the rear cavities to increase volumes of virtual rear cavities and improve response of the speakers at low frequency bands.

However, because a speaker system involves many of glues, various volatile organic compounds (VOCs) are emitted under actual environment. Zeolite low-frequency enhancement material can cause poor performance after absorption of the volatile organic compounds (VOCs).

In view of these problems, it is necessary to provide a new zeolite molecular sieve and an acoustic absorption material thereof, so as to effectively avoid a failure and improve acoustic absorption effect.

DETAILED DESCRIPTION

To make the foregoing objectives, features, and advantages of the present disclosure more apparent and comprehensive, the following describes the present disclosure in detail with reference to specific implementations, to make the foregoing and other objectives, features, and advantages of the present disclosure clearer.

To avoid performance degradation of a molecular sieve used as a low-frequency enhancement material after the molecular sieve absorbs VOCs, the present disclosure proposes that an adsorbent of a particular amount is added to the low-frequency enhancement material. For example, a first zeolite molecular sieve having a first micropore diameter is selected as an adsorbent. A macroporous zeolite molecular sieve crystal is preferably selected as a first zeolite molecular sieve, which has a first micropore diameter. A second zeolite molecular sieve having a second micropore diameter is selected as a low-frequency enhancement material. The first micropore diameter is greater than the second micropore diameter.

A molecular sieve is synthetic hydrous aluminosilicate (zeolite) or natural zeolite having a molecule screening function. The molecular sieve has many pores with uniform pore diameters and regularly arranged apertures in structure. Molecular sieves having different pore diameters separate molecules having different sizes and different shapes. Molecular sieves having different pore diameters are obtained based on different molecular ratios of $SiO_2$ to $Al_2O_3$.

Based on pore sizes, zeolite molecular sieves are mainly classified into: an 8-membered ring, a 10-membered ring, and a 12-membered ring, and a larger than 12-membered ring. In the present disclosure, the first zeolite molecular sieve used as the adsorbent is preferably high-silica hydrophobic zeolite of a 10- or larger than 10-membered ring, including a 12- or larger than 12-membered ring porous structure. A structure of zeolite molecular sieve having a 12-membered ring mainly includes: ITQ-26 (IWS), ITQ-7 (ISV), Beta (*BEA), ITQ-24 (IWR), Y (FAU), EMT (EMT), CIT-1 (CON), IM-17 (UOV), ITQ-39 (*-ITN), MCM-68 (MSE), ITQ-22 (IWW), SSZ-57 (SFV), LZ-135 (LTF), ITQ-27 (IWV), SSZ-56 (SFS), SSZ-65 (SSF), COK-14 (OKO), ECR-1 (EON), ITQ-4 (IFR), SSZ-48 (SFE), SSZ-60 (SSY), mordenite (MOR), SSZ-31 (STO), ZSM-12 (MTW), GUS-1 (GON), and VPI-8 (VET).

A structure of zeolite molecular sieve having a more-than-twelve-membered ring mainly includes: ITQ-40 (IRY), ITQ-37 (-ITV), ITQ-44 (IRR), ITQ-33 (ITT), EMM-23 (*-EWT), UTD-1F (DON), CIF-5 (CIF), and IM-12 (UTL).

Three letters in the parentheses are serial numbers corresponding to different structures provided by the International Zeolite Association. For details, refer to the official web site www.iza-structure.org.

Further, to ensure hydrophobicity and patency of the first zeolite molecular sieve, a molar ratio of silicon to non-silicon heteroatoms in T atoms in a framework should be greater than 20, preferably, greater than 50, and more preferably, greater than 80. The non-silicon heteroatoms mainly include Al, P, B, Ga, Ti, Zr, Ge, Fe, Cr, Co, and the like, but is not limited thereto.

In practical applications, in order to ensure both sufficient low-frequency improvement effects and long-term stability in a use environment, an additive amount of the adsorbent varies with a total release amount of VOCs in the use environment. That is, a higher total release amount of VOCs in the use environment leads to a larger additive amount. According to a general application environment of the speaker and VOCs test, the additive amount of the first zeolite molecular sieve is 0.01 wt %-40 wt % of a total mass of a composite zeolite molecular sieve, preferably, 0.05 wt %-15 wt % of the total mass of the composite zeolite molecular sieve, and more preferably, 0.1 wt %-8 wt % of the total mass of the composite zeolite molecular sieve, but is not limited thereto.

In this embodiment, the first zeolite molecular sieve and the second zeolite molecular sieve are mixed to be shaped into particles having a particle diameter of 10-1000 μm, preferably 30-600 μm, and more preferably 50-450 μm.

Certainly, in other embodiment, alternatively, the first zeolite molecular sieve and the second zeolite molecular sieve may be separately shaped into particles and then are enclosed together in a rear cavity of the speaker.

To better compare technical effects of the present disclosure, in the present disclosure, a speaker product containing a composite zeolite molecular sieve is put into an environment testing box for a stability test. For example, test conditions are: the temperature is 85° C., the humidity is 95%, and an evaluation time is 200 h.

During the test, the first zeolite molecular sieve used as the adsorbent selects the following chemical components:

EMM-23, where a silicon to aluminum ratio is 220 (for synthesis, refer to J. Am. Chem. Soc. 2014, 136, 13570-13573);

dealuminated EMT, where a silicon to aluminum ratio is 230;

Beta, where a silicon to aluminum ratio is 250;

dealuminated Y, where a silicon to aluminum ratio is 500;

dealuminated mordenite, where a silicon to aluminum ratio is 180;

deborated CIT-1, where a silicon to boron ratio is 150; ITQ-39, where a silicon to aluminum ratio is 150; and ITQ-7, where a silicon to aluminum ratio is 90.

The second zeolite molecular sieve used as the low-frequency enhancement material selects MFI and MEL Evaluation results are shown in Table 1.

| Number | Sample information | Low-frequency enhancement material $f_0$ reduction value/Hz before evaluation | Low-frequency enhancement material $f_0$ reduction value/Hz after evaluation |
|---|---|---|---|
| Example 1 | MFI + 5 wt % EMM-23 | 112 | 93 |
| Example 2 | MEL + 3 wt % dealuminated EMT | 114 | 92 |
| Example 3 | MEL + 7 wt % Beta | 110 | 95 |
| Example 4 | MFI + 2 wt % Beta | 115 | 88 |
| Example 5 | MFI + 4 wt % dealuminated Y | 112 | 90 |
| Example 6 | MFI + 3 wt % dealuminated mordenite | 114 | 86 |
| Example 7 | MFI + 4 wt % deborated CIT-1 | 112 | 90 |
| Example 8 | MFI + 1 wt % ITQ-39 | 118 | 89 |
| Example 9 | MFI + 3 wt % ITQ-7 | 121 | 97 |
| Comparison Example 1 | MFI | 119 | 80 |
| Comparison Example 2 | MEL | 117 | 79 |

It can be seen from the test results in Table 1 that, after the composite zeolite molecular sieve of the acoustic absorption material experiences an environmental test, the composite zeolite molecular sieve in the present disclosure still has a relatively good $f_0$ reduction effect, which is obviously better than that of a single zeolite molecular sieve without adding an adsorbent in Comparison Example 1 and Comparison Example 2. This proves that the adsorbent has an obvious effect on inhibiting performance impact of the VOCs on the low-frequency enhancement material in the environment. Stability of the acoustic absorption material in the use environment is improved.

The above descriptions are merely embodiments of the present disclosure. It should be noted herein that a person of ordinary skill in the art may make improvements without departing from the creative ideas of the present disclosure, and all these improvements shall fall within the protection scope of the present disclosure.

What is claimed is:

1. An acoustic absorption material, wherein the acoustic absorption material comprises a composite zeolite molecular sieve, the composite zeolite molecular sieve comprises a first zeolite molecular sieve having a first micropore diameter and a second zeolite molecular sieve having a second micropore diameter, where the first micropore diameter is greater than the second micropore diameter, and the first zeolite molecular sieve is used as an adsorbent, and the second zeolite molecular sieve is used as a low-frequency enhancement material.

2. The acoustic absorption material according to claim 1, wherein the first zeolite molecular sieve is high-silica hydrophobic zeolite having a larger than 10-membered ring.

3. The acoustic absorption material according to claim 2, wherein a pore of the first zeolite molecular sieve contains a 12- or larger than 12-membered ring structure.

4. The acoustic absorption material according to claim 1, wherein a molar ratio of silicon to non-silicon heteroatoms in T atoms in the first zeolite molecular sieve framework is greater than 20.

5. The acoustic absorption material according to claim 4, wherein the molar ratio of silicon to the non-silicon heteroatoms in the T atoms in the first zeolite molecular sieve framework is greater than 50.

6. The acoustic absorption material according to claim 4, wherein the molar ratio of silicon to the non-silicon heteroatoms in the T atoms in the first zeolite molecular sieve framework is greater than 80.

7. The acoustic absorption material according to claim 4, wherein the non-silicon heteroatoms comprise Al, P, B, Ga, Ti, Zr, Ge, Fe, Cr, or Co.

8. The acoustic absorption material according to any one of claim 2, wherein the first zeolite molecular sieve is EMM-23, dealuminated EMT, Beta, dealuminated Y, dealuminated mordenite, deborated CIT-1, ITQ-39, or ITQ-7.

9. The acoustic absorption material according to any one of claim 3, wherein the first zeolite molecular sieve is EMM-23, dealuminated EMT, Beta, dealuminated Y, dealuminated mordenite, deborated CIT-1, ITQ-39, or ITQ-7.

10. The acoustic absorption material according to any one of claim 4, wherein the first zeolite molecular sieve is EMM-23, dealuminated EMT, Beta, dealuminated Y, dealuminated mordenite, deborated CIT-1, ITQ-39, or ITQ-7.

11. The acoustic absorption material according to any one of claim 5, wherein the first zeolite molecular sieve is EMM-23, dealuminated EMT, Beta, dealuminated Y, dealuminated mordenite, deborated CIT-1, ITQ-39, or ITQ-7.

12. The acoustic absorption material according to any one of claim 6, wherein the first zeolite molecular sieve is EMM-23, dealuminated EMT, Beta, dealuminated Y, dealuminated mordenite, deborated CIT-1, ITQ-39, or ITQ-7.

13. The acoustic absorption material according to any one of claim 7, wherein the first zeolite molecular sieve is EMM-23, dealuminated EMT, Beta, dealuminated Y, dealuminated mordenite, deborated CIT-1, ITQ-39, or ITQ-7.

14. The acoustic absorption material according to claim 1, wherein the first zeolite molecular sieve is added in an amount of 0.01 wt %-40 wt % of a total mass of the composite zeolite molecular sieve.

15. The acoustic absorption material according to claim 10, wherein the second zeolite molecular sieve is MFI or MEL.

16. The acoustic absorption material according to claim 1, wherein the acoustic absorption material is shaped into particles having a particle diameter of 10-1000 μm.

17. The acoustic absorption material according to claim 12, wherein the particle diameter of the particle is 30-600 μm.

18. The acoustic absorption material according to claim 13, wherein the particle diameter of the particle is 50-450 μm.

19. A speaker, comprising the acoustic absorption material according to claim 1.

* * * * *